US012320055B2

(12) United States Patent
Andreen et al.

(10) Patent No.: US 12,320,055 B2
(45) Date of Patent: Jun. 3, 2025

(54) SUSPENSION MOUNT FOR A TOP LOAD WASHING MACHINE

(71) Applicant: Whirlpool Corporation, Benton Harbor, MI (US)

(72) Inventors: Derek R. Andreen, Niles, MI (US); Bradley D. Morrow, Stevensville, MI (US); Nicholas C. Fugal, Benton Charter Township, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 310 days.

(21) Appl. No.: 18/088,947

(22) Filed: Dec. 27, 2022

(65) Prior Publication Data

US 2023/0212806 A1 Jul. 6, 2023

Related U.S. Application Data

(60) Provisional application No. 63/295,595, filed on Dec. 31, 2021.

(51) Int. Cl.
*D06F 37/24* (2006.01)
*D06F 23/04* (2006.01)
(Continued)

(52) U.S. Cl.
CPC ..... *D06F 37/24* (2013.01); *D06F 23/04* (2013.01); *D06F 37/268* (2013.01); *D06F 39/12* (2013.01)

(58) Field of Classification Search
None
See application file for complete search history.

(56) References Cited

U.S. PATENT DOCUMENTS 5,884,891 A * 3/1999 Hawkins ..... D06F 37/24 68/23.3
6,397,643 B1 * 6/2002 Chang ..... D06F 37/24 68/23.1
(Continued)

FOREIGN PATENT DOCUMENTS

CN 107663740 A 2/2018
JP H06254291 A 9/1994
(Continued)

*Primary Examiner* — Cristi J Tate-Sims
(74) *Attorney, Agent, or Firm* — Harness, Dickey & Pierce, PLC

(57) ABSTRACT

A suspension mount assembly for a laundry appliance with a wash unit tub disposed inside an appliance housing and a drum that is rotatably supported within the wash unit tub. A laundry compartment is provided inside the drum and the drum is rotatable about a substantially vertical axis. The wash unit tub is hung from and supported by a plurality of suspension rods. A plurality of upper suspension mount assemblies pivotally couple the suspension rods to an upper frame of the laundry appliance and a plurality of lower suspension mount assemblies couple the suspension rods to the wash unit tub. Each of the upper and lower suspension mount assemblies includes a resilient bushing that permits relative movement between the suspension rods, the upper frame, and the wash unit tub while reducing/dampening the vibrations the suspension rods transmit from the wash unit tub to the upper frame.

16 Claims, 10 Drawing Sheets

(51) Int. Cl.
*D06F 37/26* (2006.01)
*D06F 39/12* (2006.01)

(56) References Cited

U.S. PATENT DOCUMENTS

| | | | | |
|---|---|---|---|---|
| 11,142,859 | B2 | 10/2021 | Lv et al. | |
| 2006/0059960 | A1* | 3/2006 | Hansen | D06F 37/24 68/23.1 |

FOREIGN PATENT DOCUMENTS

| | | | |
|---|---|---|---|
| JP | 2014068792 | A | 4/2014 |
| KR | 19990030773 | U | 7/1999 |
| KR | 19990051581 | A | 7/1999 |

* cited by examiner

SUSPENSION MOUNT FOR A TOP LOAD WASHING MACHINE

CROSS-REFERENCE TO RELATED APPLICATIONS

This is application claims the benefit of U.S. Provisional Application No. 63/295,595, filed on Dec. 31, 2021. The entire disclosure of the above application is incorporated herein by reference.

FIELD

The present disclosure relates generally to laundry appliances and more particularly to suspension mounts for supporting the wash unit tub/hung mass inside the cabinet of a top load/vertical axis washing machine.

BACKGROUND

The statements in this section merely provide background information related to the present disclosure and may not constitute prior art.

Laundry appliances (i.e., laundry machines and washing machines) are prolific in both residential and commercial settings, where they are used to clean laundry, such as clothes, towels, and bedding.

Many washing machines have a top-load appliance configuration, where the washing machine includes an appliance housing with a top appliance opening that is accessed by a top-mounted appliance door. Such laundry appliances typically have a wash unit tub that is hung within the appliance housing by multiple suspension rods, which allow the wash unit tub to move and oscillate to some degree inside the appliance housing. As a result, the wash unit tub is sometimes referred to as the "hung mass" of the laundry appliance. A drum is positioned inside the wash unit tub and is rotatable with respect to both wash unit tub and the appliance housing about a vertical axis of rotation. As a result, laundry appliances of this configuration are sometimes referred to as vertical axis washing machines.

A motor housed within the appliance housing rotates the drum. The drum typically has an upper drum end with a drum opening that provides access to a laundry compartment inside the drum and a lower drum end that is coupled to the motor. During wash cycles, a mixture of wash water and detergent is introduced into the laundry compartment as the drum rotates to clean the laundry located inside the laundry compartment. The degree to which the wash unit tub oscillates inside the appliance housing can increase when a heavy and/or uneven load of laundry is placed inside the laundry compartment. This can lead to unwanted vibration and noise during operation of the laundry appliance. As a result, solutions for eliminating or decreasing the vibrations the wash unit tub transmits to the appliance housing are desirable.

SUMMARY

This section provides a general summary of the disclosure and is not a comprehensive disclosure of its full scope or all of its features.

In accordance with one aspect of the present disclosure, a suspension mount assembly for a laundry appliance is provided. The laundry appliance generally includes an appliance housing, a wash unit tub disposed inside the appliance housing, and a drum that is rotatably supported within the wash unit tub. In accordance with another aspect of the present disclosure, the laundry appliance has a top-load configuration. Thus, the appliance housing includes an upper frame supporting an upper housing wall, a laundry compartment opening in the upper housing wall, and an appliance door that is pivotally mounted to the upper frame and/or upper housing wall to open and close the laundry compartment opening. The wash unit tub includes an upper tub end, a lower tub end, and a tub sidewall that extends between the upper and lower tub ends. The wash unit tub also includes a tub opening at the upper tub end, where the tub opening is aligned with the laundry compartment opening in the upper housing wall. The drum is rotatably supported within the wash unit tub for rotation about a substantially vertical axis. As such, the laundry appliance may generally be characterized as a vertical axis washing machine. It should therefore be appreciated that the drum includes a laundry compartment that is accessible through the laundry compartment opening in the upper housing wall.

The laundry appliance includes a plurality of suspension rod assemblies that extend between the upper frame of the appliance housing and the wash unit tub. The wash unit tub is hung from and supported by these suspension rod assemblies. Each suspension rod assembly includes a suspension rod that extends from an upper rod end to a lower rod end. A plurality of upper suspension mount assemblies pivotally couple upper rod ends of the suspension rods to the upper frame of the appliance housing. Each upper suspension mount assembly includes a socket that is disposed in the upper frame of the appliance housing, an upper washer positioned on the upper rod end at a fixed location, and a resilient upper bushing. The upper rod end extends through the resilient upper bushing and all or part of the resilient upper bushing is received in the socket in the upper frame of the appliance housing. As a result, the resilient upper bushing is positioned between the socket and the upper washer.

As the name implies, the resilient upper bushing is made of a resilient material. As such, the resilient upper bushing permits relative movement between the upper rod end and the socket in the upper frame of the appliance housing. The resilient upper bushing is configured to reduce and dampen vibrations transmitted between the upper rod end and the upper frame of the appliance housing. It should be appreciated that rotation of the drum during operation of the laundry appliance (e.g., during wash and/or spin cycles) can cause the wash unit tub to vibrate or oscillate. These vibrations and/or oscillations can be particularly noticeable or severe when there is a heavy and/or unbalanced load of laundry inside the laundry compartment. Advantageously, the resilient upper bushings of the present disclosure reduce and/or dampen the vibrations and oscillations that the suspension rods transmit from the wash unit tub to the appliance housing to reduce the amount of noise and vibration that is perceivable from outside the laundry appliance.

In accordance with another aspect of the present disclosure, a plurality of lower suspension mount assemblies couple the lower rod ends to the wash unit tub and more specifically to the tub sidewall. Each lower suspension mount assembly includes a lower suspension mount receptacle that is positioned along the tub sidewall, an upper spring seat that is positioned on the suspension rod, and a resilient lower bushing. The resilient lower bushing is received in the lower suspension mount receptacle and is positioned between the lower suspension mount receptacle and the upper spring seat. The resilient lower bushing is made of a resilient material. As such, the resilient lower bushing permits relative movement between the suspension rod and the lower suspension mount receptacle. Advantageously, the resilient lower bushing is configured to reduce and/or dampen vibrations and oscillations that the wash unit tub transmits to the suspension rods, which in turn reduces the amount of noise and vibration that the suspension rod assemblies transmit to the appliance housing.

Thus, it should be appreciated that the upper and lower suspension mount assemblies of the present disclosure may be incorporated into the laundry appliance separately or together on opposing ends of each suspension rod. In other words, the upper suspension mount assemblies described herein may be incorporated into a laundry appliance without inclusion of the lower suspension mount assemblies disclosed herein. Alternatively, the lower suspension mount assemblies described herein may be incorporated into a laundry appliance without inclusion of the upper suspension mount assemblies disclosed herein.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION

Figure 1:
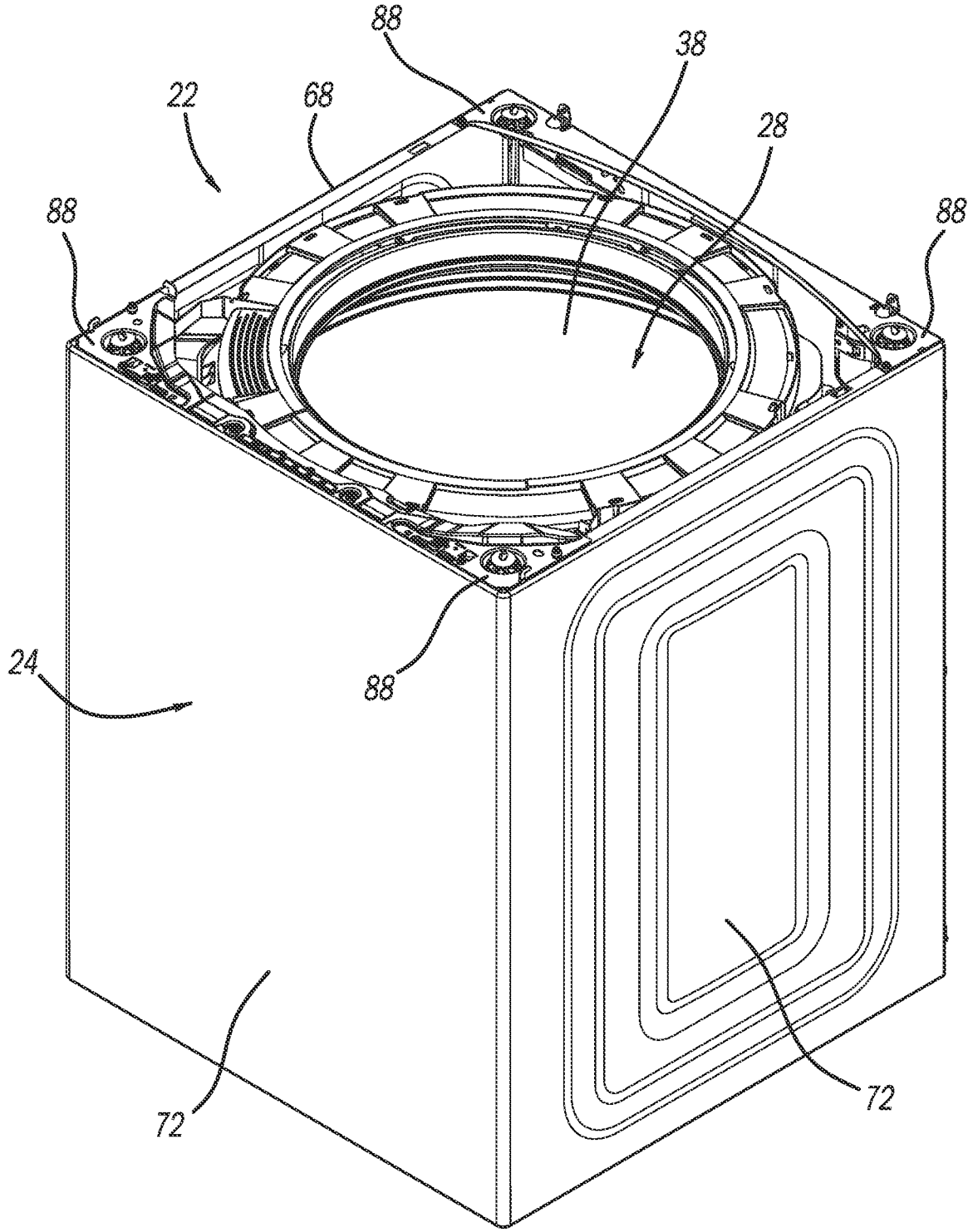
FIG. 1 is a top perspective view of an exemplary laundry appliance where the laundry appliance includes an appliance housing with a laundry compartment opening in an upper housing wall.

Referring to the Figures, wherein like numerals indicate corresponding parts throughout the several views, various suspension rod assemblies 32, 32' for a laundry appliance 22 are illustrated.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

For purposes of description herein the terms "up," "down," "above," "below," "upper," "lower," "top," "bottom," "front," "rear," and derivatives thereof shall relate to the orientations shown in FIGS. 1-12.

Figure 2:
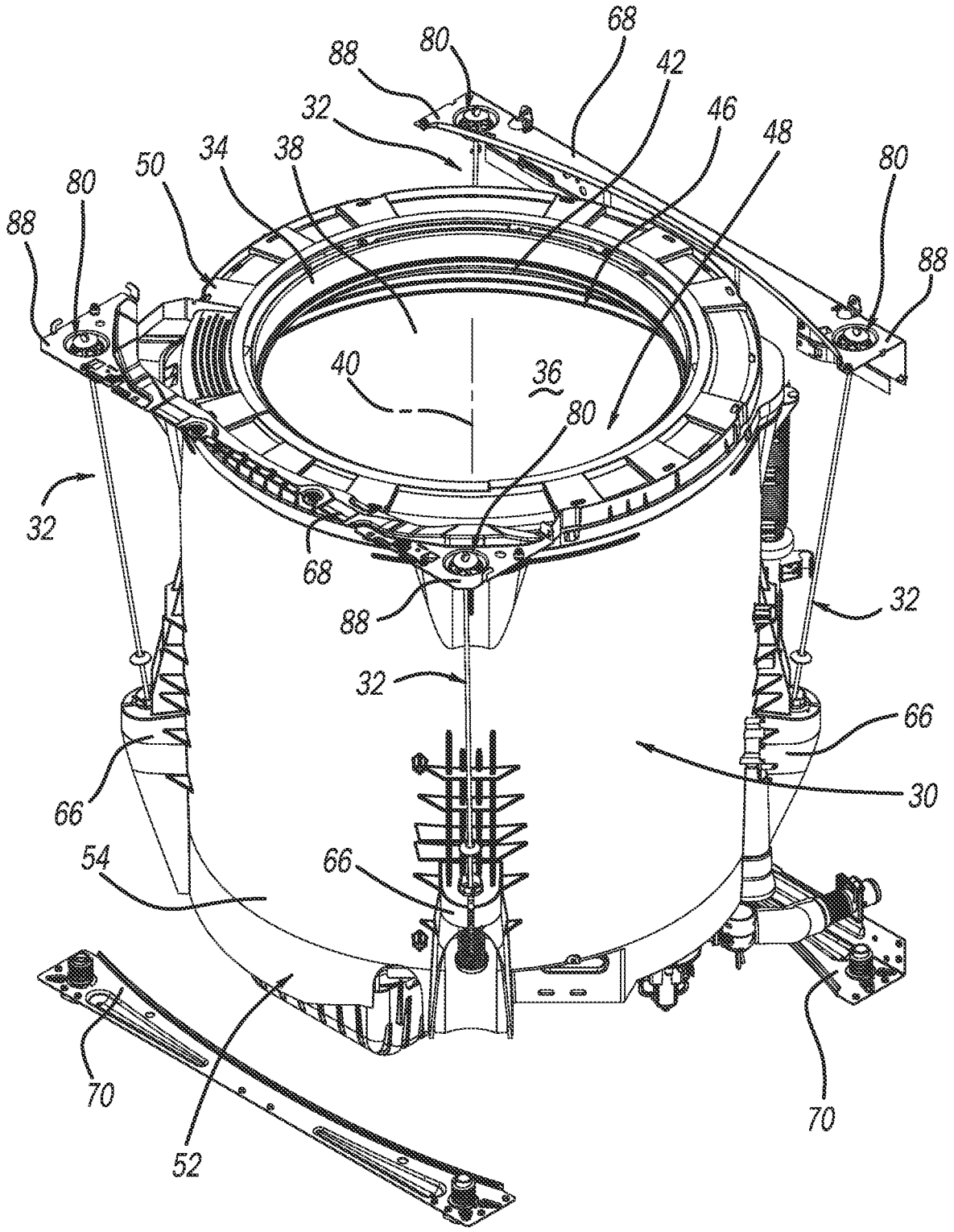
FIG. 2 is a top perspective view of part of an exemplary laundry appliance where the appliance housing shown in FIG. 1 has been removed to reveal several components of the laundry appliance, including an exemplary wash unit tub of the laundry appliance and exemplary suspension rod assemblies that have been constructed in accordance with the present disclosure.
Figure 3:
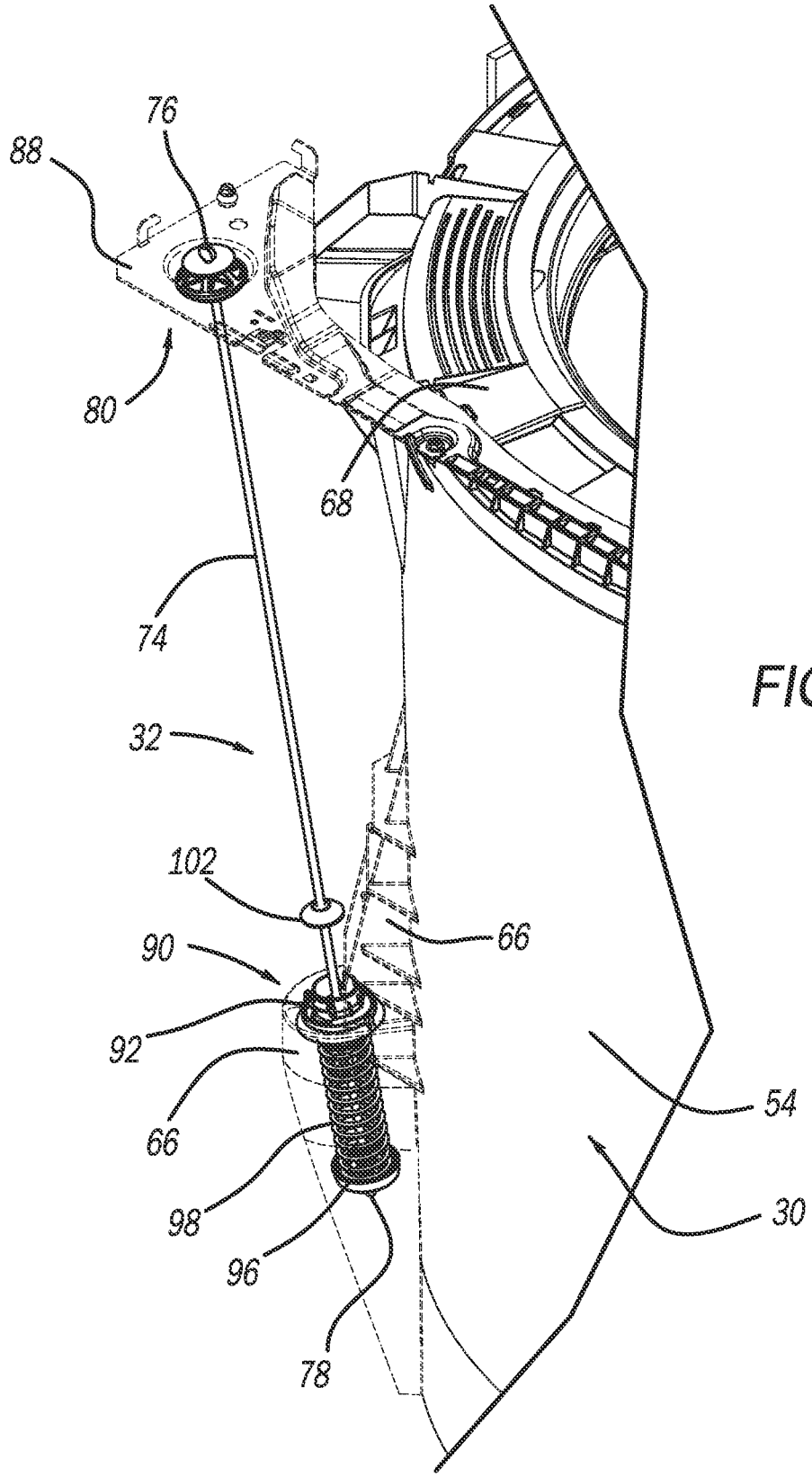
FIG. 3 is a front perspective view of part of the wash unit tub and one of the exemplary suspension rod assemblies shown in FIG. 2.
Figure 4:
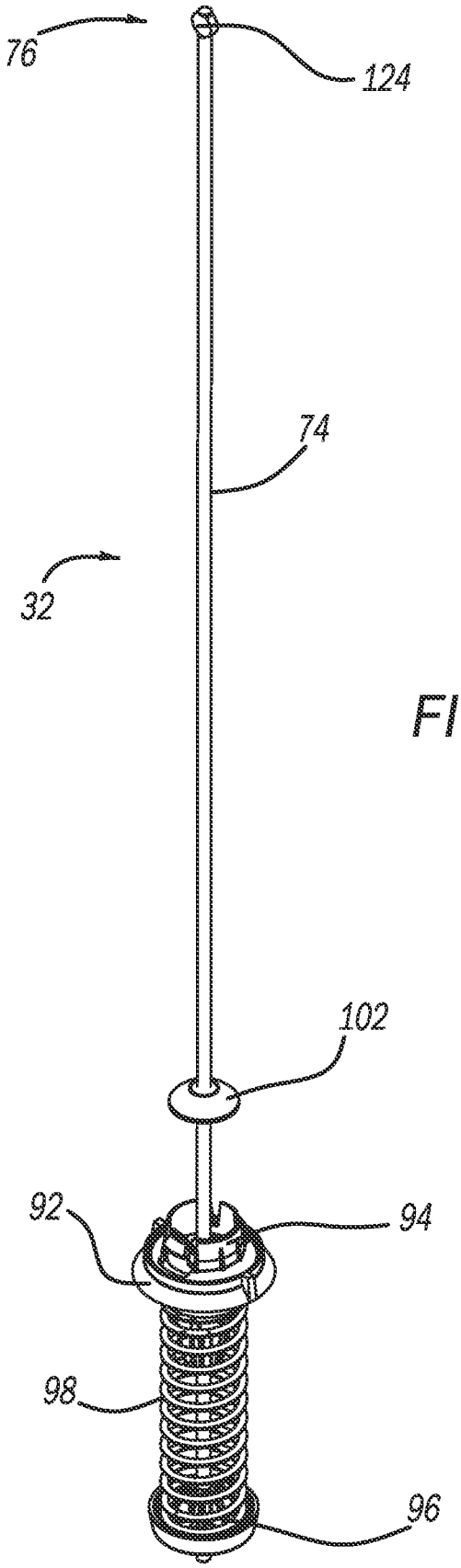
FIG. 4 is a front perspective view of the exemplary suspension rod assembly shown in FIG. 3, which includes an exemplary upper suspension mount assembly and an exemplary lower suspension mount assembly.

The laundry appliance 22 illustrated in FIGS. 1 and 2 has a top-load configuration and includes an appliance housing 24 that is rectangular in shape. A top appliance door (not shown) may be pivotally connected to the laundry appliance 22 to open and close a laundry compartment opening 28 in the appliance housing 24. The laundry appliance 22 includes a wash unit tub 30 that is mounted inside the appliance housing 24. The wash unit tub 30 is generally cylindrical in shape, but does not rotate relative to the appliance housing 24. The wash unit tub 30 is supported within the appliance housing 24 by four suspension rod assemblies 32 that give the wash unit tub 30 a limited degree of freedom, which allows the wash unit tub 30 to move/oscillate relative to the appliance housing 24 during the wash and spin cycles of the laundry appliance 22. More details regarding the suspension rod assemblies 32 is provided below. The wash unit tub 30 includes a tub opening 34 that leads to a tub cavity 36 inside the wash unit tub 30.

A drum 38 is positioned inside the tub cavity 36 and is rotatably supported within the wash unit tub 30 such that the drum 38 is rotatable with respect to the wash unit tub 30 about an axis 40. Because the laundry appliance 22 in the illustrated examples has a top-load configuration, it should be appreciated that the axis 40 extends substantially vertically (i.e., at an angle that is 80-100 degrees from horizontal). As such, the laundry appliance 22 may generally be characterized as a vertical axis washing machine. The drum 38 has a top end 42, a bottom end (not shown), and a cylindrical shape. A drum opening 46 at the top end 42 of the drum 38 provides access to a laundry compartment 48 inside the drum 38. Thus, it should be appreciated that in use, laundry (e.g., clothes, towels, and bedding) is placed inside the laundry compartment 48 where it is cleaned during a wash cycle. A drive shaft (not shown) is fixedly coupled to the bottom end of the drum 38 such that the drive shaft and the drum 38 rotate together as a single unit within the wash unit tub 30. A motor (not shown) is positioned in the appliance housing 24, beneath the drum 38, and is coupled to the drive shaft. The motor drives rotation of the drive shaft and the drum 38 relative to the wash unit tub 30 and the appliance housing 24 during operation of the laundry appliance 22, such as during wash and spin cycles.

The wash unit tub 30 includes an upper tub end 50, a lower tub end 52, and a tub sidewall 54 that extends longitudinally between the upper tub end 50 and the lower tub end 52. The tub sidewall 54 is generally cylindrical and includes four suspension support brackets 66. The suspension support brackets 66 may be fixed to or integrated in the tub sidewall 54 to provide an attachment point for the suspension rod assemblies 32, which support the wash unit tub 30 within the appliance housing 24.

The appliance housing 24 includes an upper frame 68 supporting an upper housing wall (removed in FIG. 1). The appliance door (not shown) may be pivotally mounted to the upper frame 68 and/or upper housing wall to open and close the laundry compartment opening 28. The appliance housing 24 may also include a lower frame 70 and one or more vertical walls 72 that extend between the upper and lower frames 68, 70 to form the outside surfaces of the appliance housing 24.

The wash unit tub 30 is hung from and supported by the suspension rod assemblies 32, which extend between the upper frame 68 of the appliance housing 24 and the wash unit tub 30. With additional reference to FIGS. 3-6, each suspension rod assembly 32 includes a suspension rod 74 that extends from an upper rod end 76 to a lower rod end 78.

A plurality of upper suspension mount assemblies 80 pivotally couple the upper rod ends 76 of the suspension rods 74 to the upper frame 68 of the appliance housing 24. Each upper suspension mount assembly 80 includes a cup-shaped socket 82 that is disposed in the upper frame 68 of the appliance housing 24, an upper washer 84 that is positioned on the upper rod end 76 at a fixed location, and a resilient upper bushing 86. More specifically, the upper frame 68 of the appliance housing 24 includes four corner gussets 88 and each corner gusset 88 includes one of the cup-shaped sockets 82. The upper rod end 76 extends through the resilient upper bushing 86 and at least part of the resilient upper bushing 86 is received in the cup-shaped socket 82 in the upper frame 68 of the appliance housing 24. As a result, the resilient upper bushing 86 is positioned between the cup-shaped socket 82 and the upper washer 84.

As the name implies, the resilient upper bushing 86 is made of a resilient material, such as rubber or an elastomer, for example. As such, the resilient upper bushing 86 permits relative movement between the upper rod end 76, upper washer 84, and cup-shaped socket 82 in the upper frame 68 of the appliance housing 24. The resilient upper bushing 86 is configured to reduce and dampen vibrations transmitted between the upper rod end 76 and the upper frame 68 of the appliance housing 24. It should be appreciated that rotation of the drum 38 during operation of the laundry appliance 22 (e.g., during wash and/or spin cycles) can cause the wash unit tub 30 to vibrate or oscillate. These vibrations and/or oscillations can be particularly noticeable or severe when there is a heavy and/or unbalanced load of laundry inside the laundry compartment 48. Advantageously, the resilient upper bushings 86 reduce and/or dampen the vibrations and oscillations that the suspension rods 74 would otherwise transmit from the wash unit tub 30 to the appliance housing 24 and ultimately reduce the amount of noise and vibration that can be perceived from outside the laundry appliance 22.

A plurality of lower suspension mount assemblies 90 couple the lower rod ends 78 to the wash unit tub 30 and more specifically to the tub sidewall 54. Each lower suspension mount assembly 90 includes a lower suspension mount receptacle 92 that is positioned in the suspension support brackets 66 on the tub sidewall 54, an upper spring seat 94 that is positioned in sliding engagement on the suspension rod 74, and a lower spring seat 96 that is positioned on the lower rod end 78 at a fixed location, a spring 98 that extends helically about the suspension rod 74 between the upper and lower spring seats 94, 96, and a resilient lower bushing 100. Optionally, each lower suspension mount assembly 90 may include a bump stop 102 that acts as an upper travel limit for the wash unit tub 30.

The resilient lower bushing 100 is received in the lower suspension mount receptacle 92 and is positioned between the lower suspension mount receptacle 92 and the upper spring seat 94. The resilient lower bushing 100 is made of a resilient material, such as rubber or an elastomer, for example. As such, the resilient lower bushing 100 permits relative movement between the suspension rod 74, upper spring seat 94, and lower suspension mount receptacle 92/suspension support bracket 66. Advantageously, the resilient lower bushing 100 is configured to reduce and/or dampen vibrations and oscillations that the wash unit tub 30 would otherwise transmit to the suspension rods 74, which in turn reduces the amount of noise and vibration that the suspension rod assemblies 32 transmit to the appliance housing 24.

Figure 5:
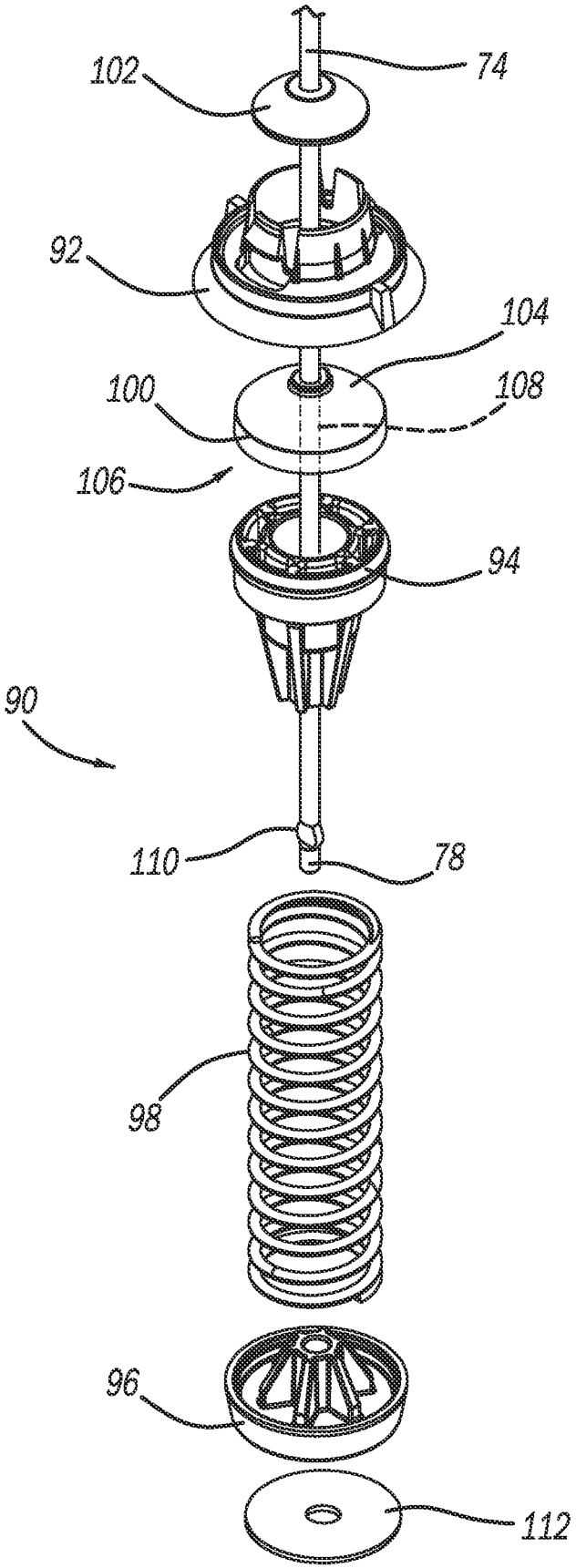
FIG. 5 is an exploded perspective view of the exemplary lower suspension mount assembly shown in FIG. 4.

As best seen in FIG. 5, each resilient lower bushing 100 includes an inboard face 104 that is hemispherical in shape and that is arranged in direct contact with the lower suspension mount receptacle 92, an outboard face 106 that is arranged in direct contact with the upper spring seat 94, and a through-bore 108 that extends through the resilient lower bushing 100 between the inboard and outboard faces 104, 106. The through-bore 108 in the resilient lower bushing 100 receives the suspension rod 74 in sliding engagement. The lower suspension mount assembly 90 also includes a lower swedge 110 on the lower rod end 78 and a lower washer 112 that directly contacts and is positioned between the lower swedge 110 and the lower spring seat 96.

Figure 6:
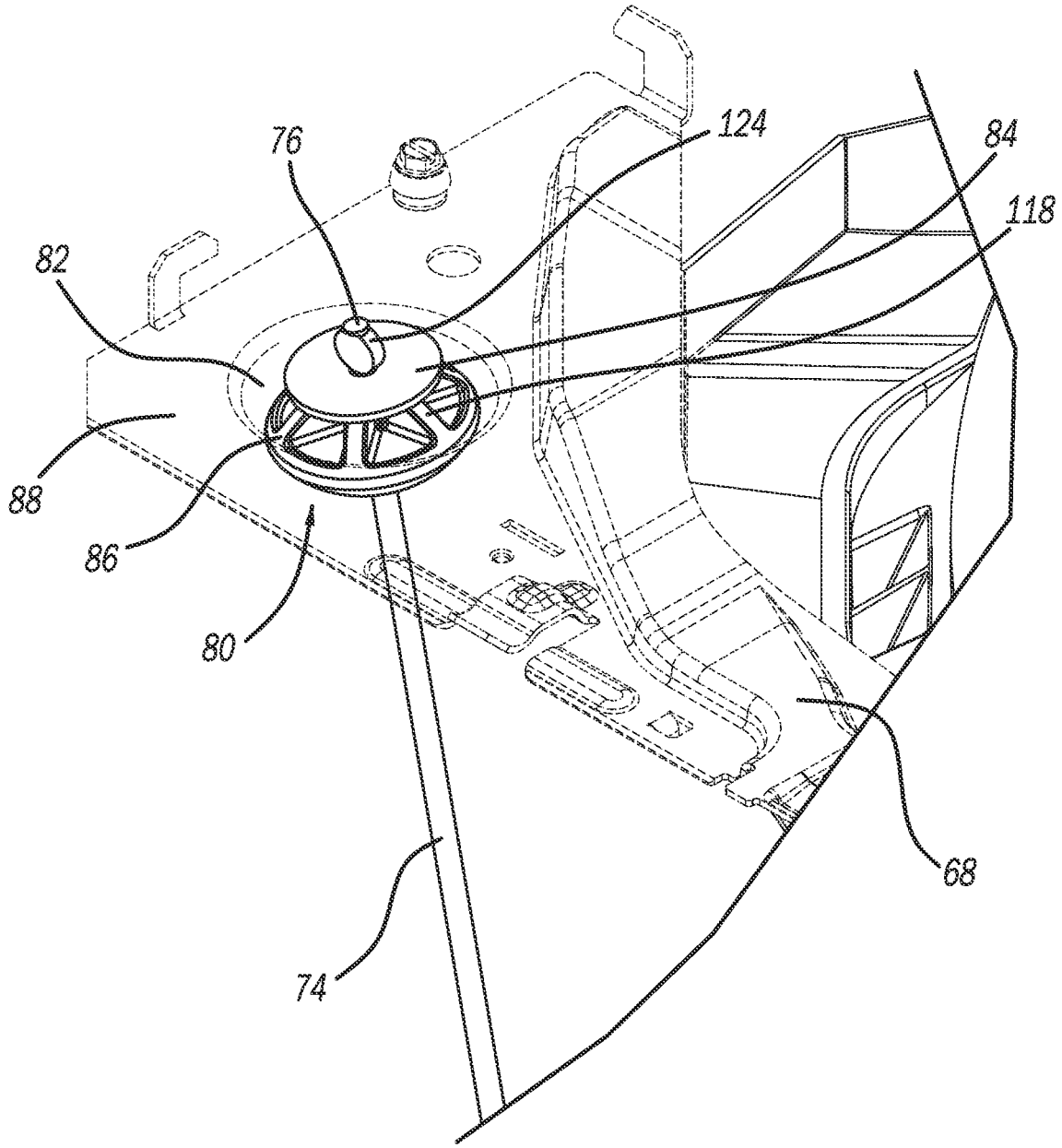
FIG. 6 is an enlarged top perspective view of the exemplary upper suspension mount assembly shown in FIG. 4.
Figure 7A:
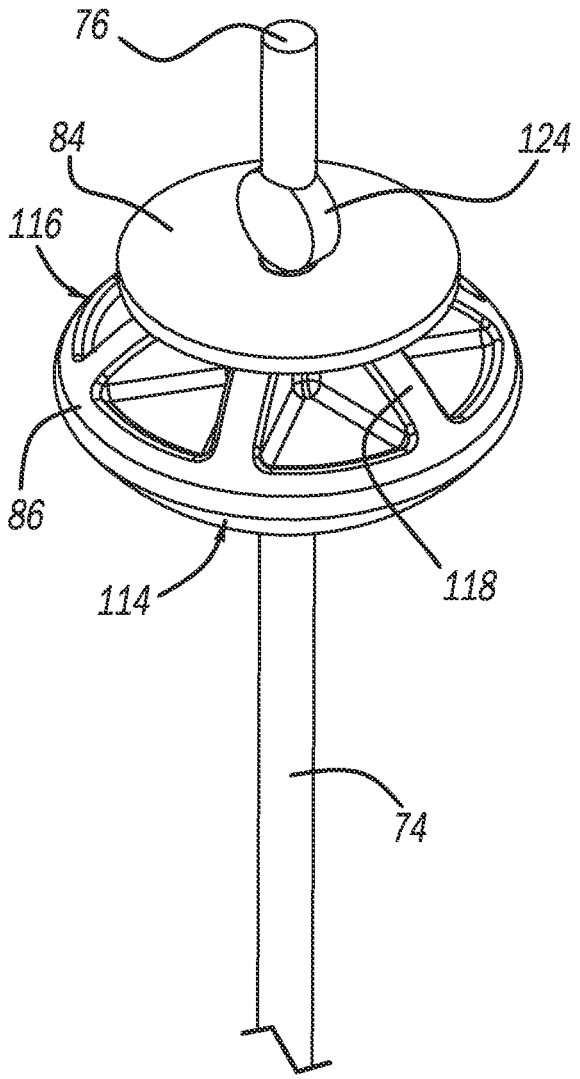
FIG. 7A is an enlarged top perspective view of an upper rod end, upper washer, and resilient upper bushing of the exemplary upper suspension mount assembly shown in FIG. 4.
Figure 7B:
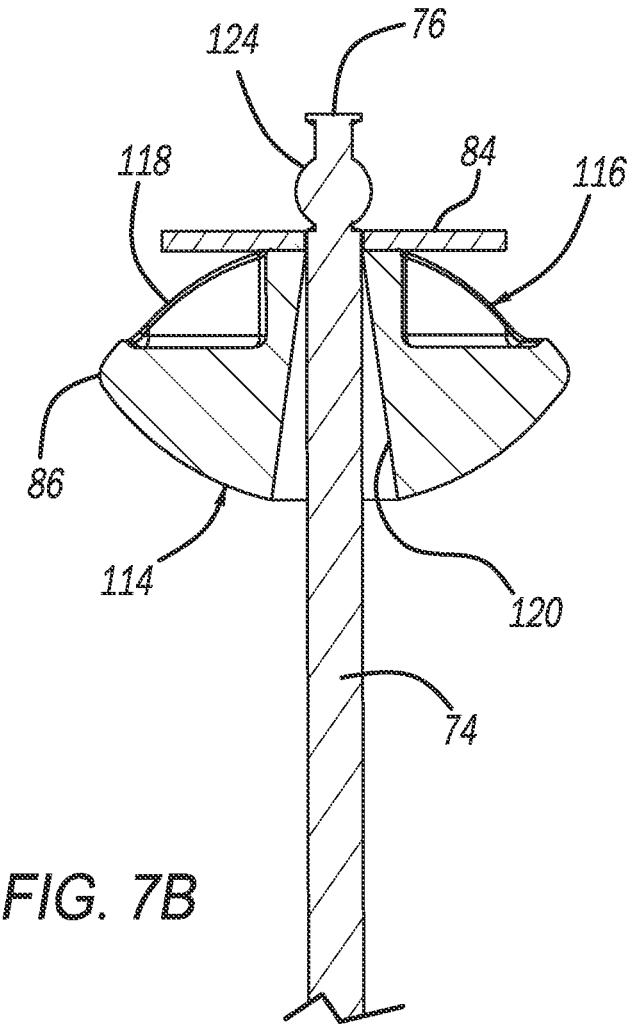
FIG. 7B is a side cross-section view of the upper rod end, upper washer, and resilient upper bushing of the exemplary upper suspension mount assembly shown in FIG. 7A.
Figure 8:
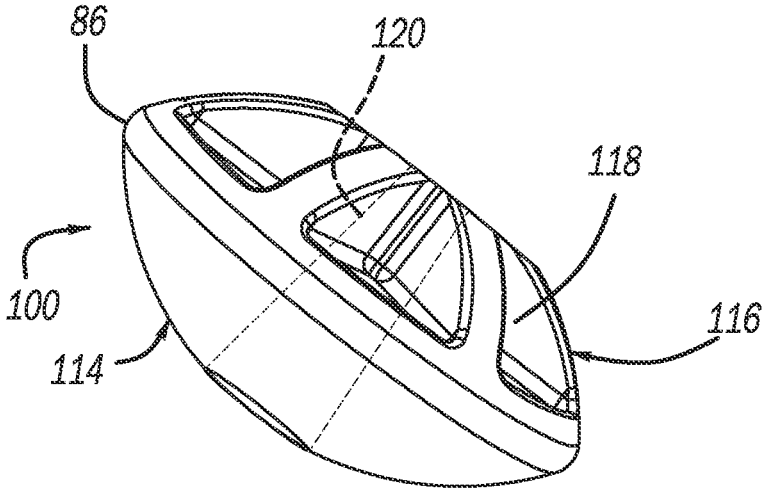
FIG. 8 is an enlarged side perspective view of the resilient upper bushing of the exemplary upper suspension mount assembly shown in FIG. 4.

With reference to FIGS. 6-8, each resilient upper bushing 86 includes an inboard face 114 that is hemispherical in shape and that is arranged in direct contact with the cup-shaped socket 82 in the upper frame 68, an outboard face 116 that includes a plurality of arc-shaped ribs 118 that extend upward to directly contact the upper washer 84, and a through-bore 120 that extends through the resilient upper bushing 86 between the inboard and outboard faces 114, 116. The through-bore 120 of the resilient upper bushing 86 receives the upper rod end 76 in sliding engagement. Preferably, at least a portion of the through-bore 120 has a frustoconical shape that gradually increases in diameter moving from the outboard face 116 of the resilient upper bushing 86 to the inboard face 114 of the resilient upper bushing 86, which helps permit the suspension rod 74 to tilt/gimbal relative to the resilient upper bushing 86. However, it should be appreciated through-bore 120 may alternatively have an enlarged stepped portion/cavity or a hemispherical portion/cavity that helps permit the suspension rod 74 to tilt/gimbal relative to the resilient upper bushing 86. The upper suspension mount assembly 80 also includes an upper swedge 124 on the upper rod end 76. In accordance with this configuration, the upper washer 84 directly contacts and is positioned between the upper swedge 124 and the outboard face 116 of the resilient upper bushing 86.

Figure 9:
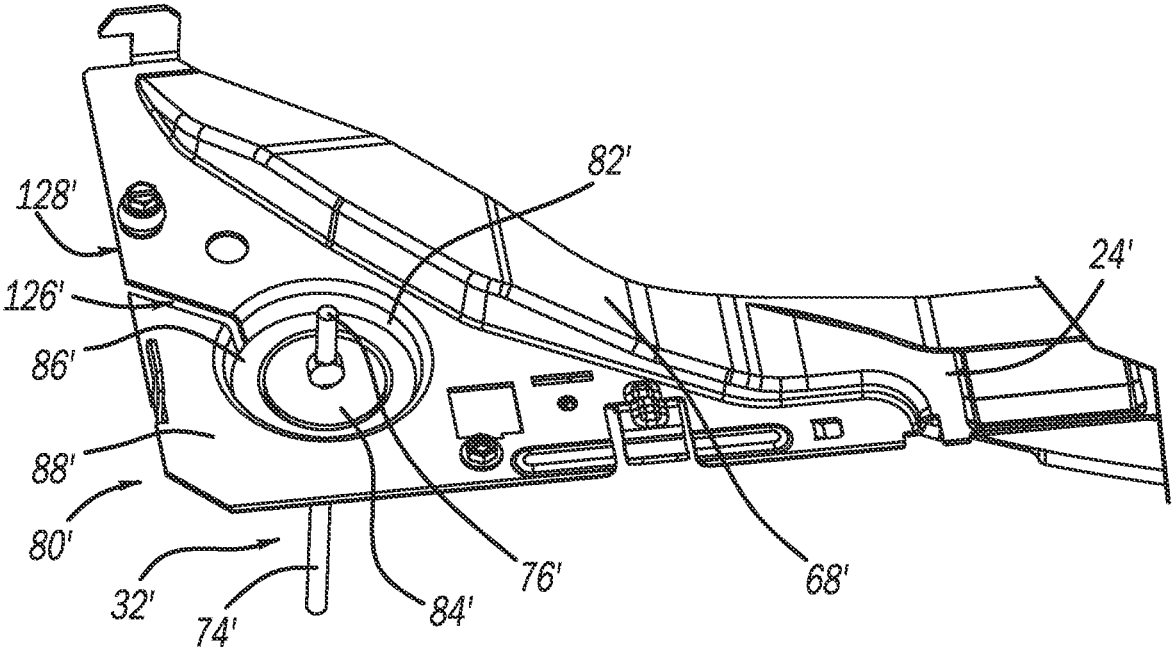
FIG. 9 is a top perspective view of another exemplary upper suspension mount assembly, which includes a resilient upper bushing that is constructed in accordance with another aspect of the present disclosure.
Figure 10:
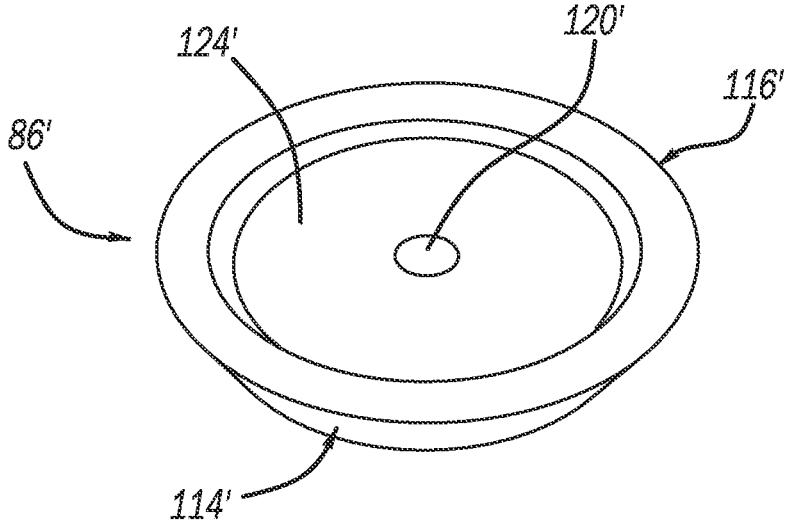
FIG. 10 is an enlarged top perspective view of the resilient upper bushing of the exemplary upper suspension mount assembly shown in FIG. 9.

FIGS. 9 and 10 illustrate an alternative upper suspension mount assembly 80' that uses a resilient upper bushing 86' with a different configuration than the resilient upper bushing 86 shown in FIGS. 1-8 and described above. Except for the structure described below, the upper suspension mount assembly 80' shown in FIGS. 9 and 10 is the same or substantially the same as the upper suspension mount assembly 80 shown in FIGS. 1-8 and described above. As a result, the elements in FIGS. 9 and 10 that correspond with the previously described structure share the same reference numerals except that a prime (') annotation has been added to the reference numbers illustrated in FIGS. 9 and 10.

Like in the previous embodiment, the resilient upper bushing 86' illustrated in FIGS. 9 and 10 includes an inboard face 114' that is hemispherical in shape and an outboard face 116'. The inboard face 114' of the resilient upper bushing 86' is arranged in direct contact with the cup-shaped socket 82' in the upper frame 68'. In accordance with this embodiment, the outboard face 116' of the resilient upper bushing 86' includes a pocket 124' that is recessed/inset in the outboard face 116' of the resilient upper bushing 86' and receives the upper washer 84'. Like in the previous embodiment, a through-bore 120' that extends through the resilient upper bushing 86', which receives the upper rod end 76'.

Like in the embodiment described above, the upper frame 68' of the appliance housing 24' includes four corner gussets 88'. Each corner gusset 88' includes one of the cup-shaped sockets 82' and a slot 126' that extends from an edge 128' of the corner gusset 88' to the cup-shaped socket 82' to allow the suspension rod 74' to slide laterally into the cup-shaped socket 82' during assembly. While the slot 126' in the illustrated example extends from an outer edge 128' of the corner gusset 88', it should be appreciated that the slot 126' could alternatively extend from an inner edge of the corner gusset 88'/upper frame 68'.

Figure 11:
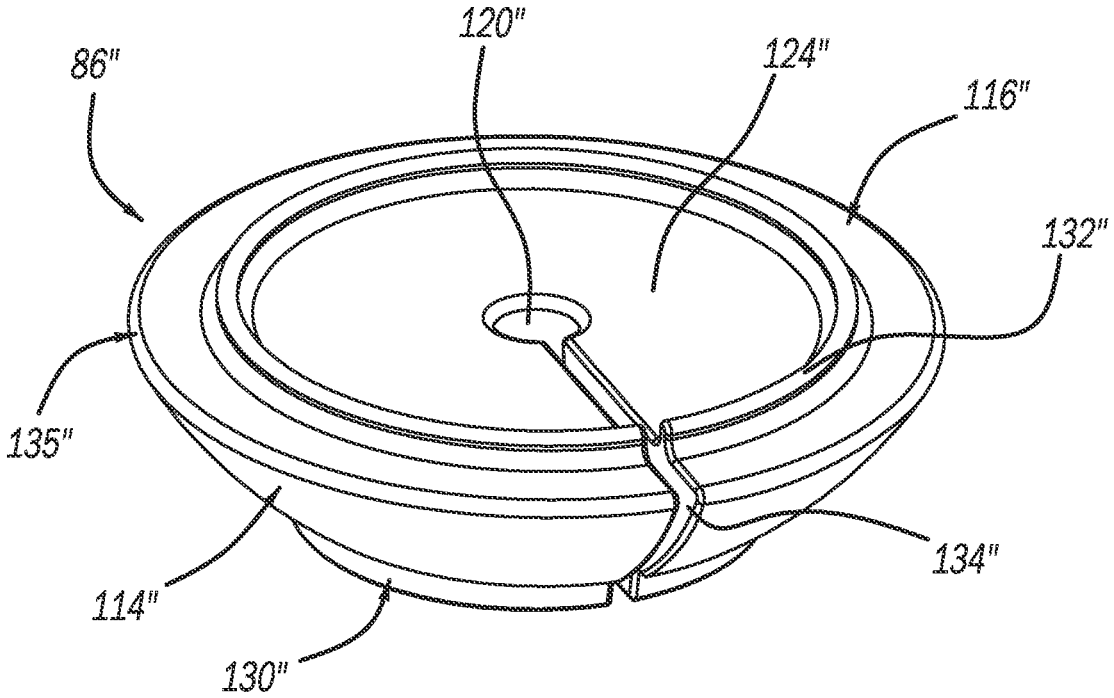
FIG. 11 is an enlarged top perspective view of another exemplary resilient upper bushing for the exemplary upper suspension mount assembly shown in FIG. 2.
Figure 12:
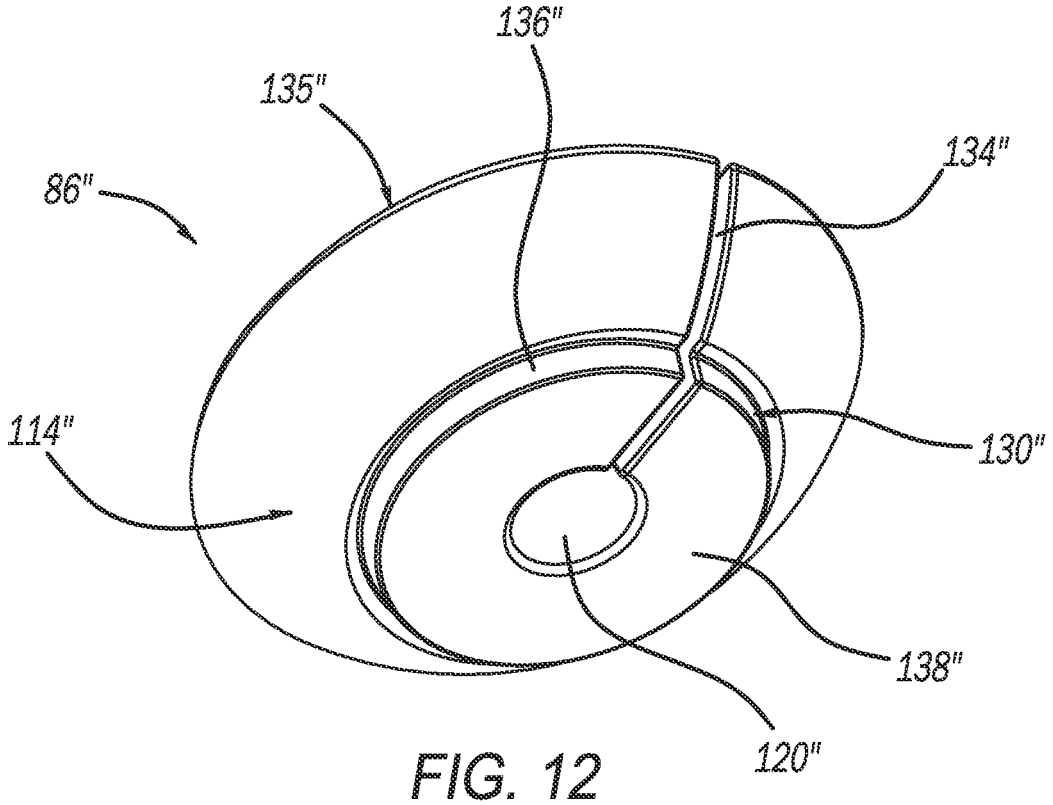
FIG. 12 is an enlarged bottom perspective view of the exemplary resilient upper bushing shown in FIG. 11.

FIGS. 11 and 12 illustrate another alternative resilient upper bushing 86" with a different configuration than the resilient upper bushings 86, 86' shown in FIGS. 1-10 and described above. Except for the structure described below, the resilient upper bushing 86" shown in FIGS. 11 and 12 is the same or substantially the same as the resilient upper bushings 86, 86' shown in FIGS. 1-10 and described above. As a result, the elements in FIGS. 11 and 12 that correspond with the previously described structure share the same reference numerals except that a double prime (") annotation has been added to the reference numbers illustrated in FIGS. 11 and 12.

Like in the previous embodiment, the resilient upper bushing 86" illustrated in FIGS. 11 and 12 includes an inboard face 114" that is hemispherical in shape and an outboard face 116". Like in the embodiments described above, the inboard face 114" of the resilient upper bushing 86" is configured to be arranged in direct contact with the cup-shaped socket 82, 82' in the upper frame 68, 68'. However, in accordance with this embodiment, the resilient upper bushing 86" includes a protrusion 130" that extends out away from the inboard face 114" of the resilient upper bushing 86" in a direction away from the outboard face 116". Like in the previous embodiment, the outboard face 116" of the resilient upper bushing 86" includes a pocket 124" that is configured to receive the upper washer 84, 84' and a through-bore 120" that extends through the resilient upper bushing 86', which is configured to receive the upper rod end 76, 76'. Preferably, the through-bore 120" has a frustoconical shape that gradually increases in diameter moving from the outboard face 116" of the resilient upper bushing 86" to the inboard face 114" of the resilient upper bushing 86", which helps permit the suspension rod 74, 74' to tilt/gimbal relative to the resilient upper bushing 86".

In the illustrated embodiment shown in FIGS. 11 and 12, the pocket 124" is defined by a rib 132" that extends out away from the outboard face 116" of the resilient upper bushing 86" in a direction away from the inboard face 114". The rib 132" as illustrated has an annular (i.e., ring-like shape) that extends about the upper washer 84, 84'. The resilient upper bushing 86" also has a slit 134" that extends radially through half of the resilient upper bushing 86" from the through-bore 120" to an outer diameter 135" of the resilient upper bushing 86". The slit 134" allows the resilient upper bushing 86" to slide laterally over and be clipped onto the upper rod end 76, 76' or removed from the upper rod end 76, 76' without disassembly or removal of the upper washer 84, 84'. In accordance with this aspect of the disclosure, the slots 126' in the upper frame 68' may be eliminated and replaced by slits 134" in the resilient upper bushings 86".

Although other shapes are possible, in the illustrated example, the protrusion 130" has a cylindrical shape. More specifically, the protrusion 130" has a cylindrical sidewall 136" and an end wall 138". The cylindrical sidewall 136" extends longitudinally away from the inboard face 114" of the resilient upper bushing 86" in a direction away from the outboard face 116" and terminates at the end wall 138", which has a flat, circular shape.

The cup-shaped socket 82, 82' in the upper frame 68, 68' is complementary in shape to the shape of the protrusion 130" and the inboard face 114" of the resilient upper bushing 86". As a result, the protrusion 130" aids in limiting/preventing any sliding or rolling motion of the resilient upper bushing 86" relative to and within the cup-shaped socket 82, 82'. Such sliding/rolling motions of the resilient upper bushing 86" are not preferred. Instead, tilting/gimbling movements of the upper rod end 76, 76' inside the through-bore 120" are preferred as this mode of movement provides better dampening performance. The protrusion 130" therefore helps facilitate this preferred dampening mode by holding the resilient upper bushing 86" in place with respect to the cup-shaped socket 82, 82' in the upper frame 68, 68'.

While FIGS. 6-12 and the above description focus on the structure and geometry of resilient upper bushings 86, 86', 86", it should be readily appreciated that the same structure and geometry of the resilient upper bushings 86, 86', 86" and the corresponding teachings set forth above may be applied equally to the resilient lower bushing 100 shown in FIG. 5 to aid in vibration attenuation and dampening.

Many modifications and variations of the apparatus and assemblies described in the present disclosure are possible in light of the above teachings and may be practiced otherwise than as specifically described while within the scope of the appended claims. These antecedent recitations should be interpreted to cover any combination in which the inventive novelty exercises its utility.

What is claimed is:

1. A laundry appliance, comprising:

an appliance housing, said appliance housing including an upper frame, an upper housing wall, and a laundry compartment opening in said upper housing wall;

a wash unit tub disposed inside said appliance housing;

a drum rotatably supported within said wash unit tub, said drum including a laundry compartment that is accessible through said laundry compartment opening in said upper housing wall;

a plurality of suspension rod assemblies extending between said upper frame of said appliance housing and said wash unit tub;

said wash unit tub being hung from and supported by said plurality of suspension rod assemblies;

each of said suspension rod assemblies including a suspension rod that extends from an upper rod end to a lower rod end;

a plurality of upper suspension mount assemblies pivotally coupling said upper rod end of each one of said suspension rods to said upper frame of said appliance housing; and each of said upper suspension mount assemblies including a socket disposed in said upper frame of said appliance housing, an upper washer positioned on said upper rod end at a fixed location, and a resilient upper bushing that is at least partially received in said socket in said upper frame of said appliance housing and is positioned between said socket and said upper washer, wherein said resilient upper bushing is made of a resilient material such that said resilient upper bushing permits relative movement between said upper rod end and said socket in said upper frame of said appliance housing and is configured to reduce and dampen vibrations transmitted between said upper rod end and said upper frame of said appliance housing, wherein each of said resilient upper bushings includes an inboard face that is arranged in direct contact with said socket, an outboard face that is arranged to directly contact said upper washer, and a through-bore that extends between said inboard and outboard faces of said resilient upper bushing and wherein said through-bore receives said upper rod end, wherein said socket has a cup-like shape, said inboard face of each of said resilient upper bushings is hemispherical in shape, and said outboard face of each of said resilient upper bushings includes a plurality of arc-shaped ribs that extend upward to directly contact said upper washer.

2. The laundry appliance as set forth in claim 1, wherein at least a portion of said through-bore has a frustoconical shape that gradually increases in diameter moving from said outboard face of said resilient upper bushing to said inboard face of said resilient upper bushing and is configured to permit said suspension rod to gimbal relative to said resilient upper bushing.

3. The laundry appliance as set forth in claim 1, wherein said resilient upper bushing includes a protrusion that extends out away from said inboard face of said resilient upper bushing in a direction away from said outboard face and where said socket in said upper frame is complementary in shape to said inboard face of said resilient upper bushing and said protrusion such that said protrusion operates to limit sliding and rolling motion of said resilient upper bushing relative to and within said socket.

4. The laundry appliance as set forth in claim 1, wherein said outboard face of each of said resilient upper bushings includes a pocket that receives said upper washer.

5. The laundry appliance as set forth in claim 4, wherein said pocket is defined by a rib that extends out away from said outboard face of said resilient upper bushing in a direction away from said inboard face and wherein said rib has an annular shape that extends about said upper washer.

6. The laundry appliance as set forth in claim 1, wherein said resilient upper bushing has a slit that extends radially through said resilient upper bushing from said through-bore to an outer diameter of said resilient upper bushing to permit said resilient upper bushing to slide laterally over said upper rod end during assembly or disassembly.

7. The laundry appliance as set forth in claim 1, wherein said upper frame of said appliance housing includes four corner gussets that each include one of said sockets and wherein each of said corner gussets includes a slot that extends from one edge of said corner gusset to said socket to allow said upper rod end to slide laterally into said socket during assembly.

8. The laundry appliance as set forth in claim 1, wherein each of said upper suspension mount assemblies includes a swedge on said upper rod end and wherein said upper washer directly contacts and is positioned between said swedge and said outboard face of said resilient upper bushing.

9. The laundry appliance as set forth in claim 1, further comprising:

a plurality of lower suspension mount assemblies coupling said lower rod end of each one of said suspension rods to said wash unit tub; and each of said lower suspension mount assemblies including a lower suspension mount receptacle on said wash unit tub and a resilient lower bushing that is received in said lower suspension mount receptacle, wherein said resilient lower bushing is made of a resilient material such that said resilient lower bushing permits relative movement between said suspension rod and said lower suspension mount receptacle and is configured to reduce and dampen vibrations transmitted between said wash unit tub and said suspension rod.

10. A laundry appliance, comprising:

an appliance housing, said appliance housing including an upper frame, an upper housing wall, and a laundry compartment opening in said upper housing wall;

a wash unit tub disposed inside said appliance housing, said wash unit tub including a tub sidewall and a tub opening that is aligned with said laundry compartment opening in said upper housing wall;

a drum rotatably supported within said wash unit tub, said drum including a laundry compartment that is accessible through said laundry compartment opening in said upper housing wall;

a plurality of suspension rod assemblies extending between said upper frame of said appliance housing and said wash unit tub;

said wash unit tub being hung from and supported by said plurality of suspension rod assemblies;

each of said suspension rod assemblies including a suspension rod that extends from an upper rod end to a lower rod end;

a plurality of lower suspension mount assemblies coupling said lower rod end of each one of said suspension rods to a suspension support bracket on said tub sidewall; and each of said lower suspension mount assemblies including a lower suspension mount receptacle that is positioned in said support bracket on said tub sidewall and a resilient lower bushing that is received in said lower suspension mount receptacle, wherein said resilient lower bushing is made of a resilient material such that said resilient lower bushing permits relative movement between said suspension rod and said lower suspension mount receptacle and is configured to reduce and dampen vibrations transmitted between said tub sidewall and said suspension rod, wherein each of said resilient upper bushings includes an inboard face that is arranged in direct contact with said lower suspension mount receptable, an outboard face that is arranged to directly contact a spring seat mounted on said lower rod end, and a through-bore that extends between said inboard and outboard faces of said resilient upper bushing and wherein said through-bore receives said upper rod end, wherein said inboard face of each of said resilient lower bushings is hemispherical in shape.

11. The laundry appliance as set forth in claim 10, wherein at least a portion of said through-bore has a frustoconical shape that gradually increases in diameter moving from said outboard face of said resilient lower bushing to said inboard face of said resilient lower bushing and is configured to permit said suspension rod to gimbal relative to said resilient lower bushing.

12. The laundry appliance as set forth in claim 10, wherein said resilient lower bushing includes a protrusion that extends out away from said inboard face of said resilient lower bushing in a direction away from said outboard face and where said lower suspension mount receptacle is complementary in shape to said inboard face of said resilient lower bushing and said protrusion such that said protrusion operates to limit sliding and rolling motion of said resilient lower bushing relative to and within said lower suspension mount receptacle.

13. A laundry appliance, comprising:

an appliance housing, said appliance housing including an upper frame supporting an upper housing wall, a laundry compartment opening in said upper housing wall, and an appliance door that is pivotally mounted to at least one of said upper frame and upper housing wall to open and close said laundry compartment opening;

a wash unit tub disposed inside said appliance housing, said wash unit tub including an upper tub end, a lower tub end, a tub sidewall extending between said upper and lower tub ends, and a tub opening at said upper tub end that is aligned with said laundry compartment opening in said upper housing wall;

a drum rotatably supported within said wash unit tub for rotation about a substantially vertical axis, said drum including a laundry compartment that is accessible through said laundry compartment opening in said upper housing wall;

a plurality of suspension rod assemblies extending between said upper frame of said appliance housing and said wash unit tub;

said wash unit tub being hung from and supported by said plurality of suspension rod assemblies;

each of said suspension rod assemblies including a suspension rod that extends from an upper rod end to a lower rod end;

a plurality of upper suspension mount assemblies pivotally coupling said upper rod end of each one of said suspension rods to said upper frame of said appliance housing; and each of said upper suspension mount assemblies including a socket disposed in said upper frame of said appliance housing, an upper washer positioned on said upper rod end at a fixed location, and a resilient upper bushing that is at least partially received in said socket in said upper frame of said appliance housing and is positioned between said socket and said upper washer, wherein said resilient upper bushing is made of a resilient material such that said resilient upper bushing permits relative movement between said upper rod end and said socket in said upper frame of said appliance housing and is configured to reduce and dampen vibrations transmitted between said upper rod end and said upper frame of said appliance housing, wherein each of said resilient upper bushings includes an inboard face that is arranged in direct contact with said socket, an outboard face that is arranged to directly contact said upper washer, and a through-bore that extends between said inboard and outboard faces of said resilient upper bushing and receives said upper rod end, wherein said inboard face is hemispherical in shape and said outboard face includes a pocket that receives said upper washer.

14. The laundry appliance as set forth in claim 13, wherein said outboard face includes a plurality of arc-shaped ribs that extend upward to directly contact said upper washer.

15. The laundry appliance as set forth in claim 13, wherein at least a portion of said through-bore has a frustoconical shape that gradually increases in diameter moving from said outboard face of said resilient upper bushing to said inboard face of said resilient upper bushing and is configured to permit said suspension rod to gimbal relative to said resilient upper bushing.

16. The laundry appliance as set forth in claim 13, wherein said resilient upper bushing includes a protrusion that extends out away from said inboard face of said resilient upper bushing in a direction away from said outboard face and where said socket in said upper frame is complementary in shape to said inboard face of said resilient upper bushing and said protrusion such that said protrusion operates to limit sliding and rolling motion of said resilient upper bushing relative to and within said socket.

* * * * *